US010179388B2

(12) United States Patent
Sroka et al.

(10) Patent No.: US 10,179,388 B2
(45) Date of Patent: Jan. 15, 2019

(54) HIGH THROUGHPUT FINISHING OF METAL COMPONENTS

(75) Inventors: Gary Sroka, Missouri City, TX (US); Omer El-Saeed, Houston, TX (US); Frank Reeves, Goshen, CT (US)

(73) Assignee: REM Technologies, Inc., Southington, CT (US)

( * ) Notice: Subject to any disclaimer, the term of this patent is extended or adjusted under 35 U.S.C. 154(b) by 231 days.

(21) Appl. No.: 12/620,231

(22) Filed: Nov. 17, 2009

(65) Prior Publication Data

US 2010/0288398 A1 Nov. 18, 2010

Related U.S. Application Data

(60) Provisional application No. 61/215,981, filed on May 12, 2009.

(51) Int. Cl.

| | |
|---|---|
| ***C23C 22/77*** | (2006.01) |
| ***B24B 31/00*** | (2006.01) |
| ***B24B 1/04*** | (2006.01) |
| ***C23C 22/73*** | (2006.01) |

(52) U.S. Cl.

CPC ..... *B24B 31/003* (2013.01); *B24B 1/04* (2013.01); *C23C 22/73* (2013.01)

(58) Field of Classification Search

CPC ..... B24B 1/04; B24B 31/003; C23C 22/73; C23C 22/77; C23C 22/82

See application file for complete search history.

(56) References Cited

U.S. PATENT DOCUMENTS

| | | | | |
|---|---|---|---|---|
| 3,516,203 | A | 6/1970 | Hambright | |
| 3,566,552 | A | 3/1971 | Hambright | |
| RE27,412 | E | 6/1972 | Olson et al. | |
| 4,034,519 | A | 7/1977 | Balz | |
| 4,181,540 | A | 1/1980 | Ahlf | |
| 4,205,487 | A | 6/1980 | Anderson et al. | |
| 4,361,989 | A | 12/1982 | Ohno | |
| 4,446,656 | A | 5/1984 | Kobayashi | |
| 4,491,500 | A * | 1/1985 | Michaud | C23C 22/73 216/102 |
| 4,724,041 | A | 2/1988 | Sherman | |

(Continued)

FOREIGN PATENT DOCUMENTS

| | | |
|---|---|---|
| EP | 0294245 A1 | 12/1987 |
| EP | 0845327 A2 | 6/1998 |

(Continued)

OTHER PUBLICATIONS

Extended European Patent Office Search Report for Application No. EP09166875.6-2302 dated Oct. 27, 2009.

(Continued)

*Primary Examiner* — Lois L Zheng

(74) *Attorney, Agent, or Firm* — Jones Walker LLP

(57) ABSTRACT

A method for finishing a surface of a metal component is carried out in a receptacle containing a quantity of non-abrasive media. The component is at least partially immersed in the media and a quantity of active finishing chemistry is supplied. The chemistry forms a relatively soft conversion coating on the surface. By inducing high energy relative movement between the surface and the media the coating can be continuously removed. The method may be carried out in a drag finishing machine.

22 Claims, 4 Drawing Sheets

(56) References Cited

U.S. PATENT DOCUMENTS

| | | | | |
|---|---|---|---|---|
| 4,724,042 | A | 2/1988 | Sherman | |
| 4,818,333 | A | 4/1989 | Michaud | |
| 4,823,513 | A | 4/1989 | Marcus et al. | |
| 5,251,409 | A | 10/1993 | Orbank | |
| 6,261,154 | B1 | 7/2001 | McEneny | |
| 6,918,818 | B2 | 7/2005 | Rüdiger | |
| 7,005,080 | B2 | 2/2006 | Holland et al. | |
| 7,048,613 | B2 | 5/2006 | Rüdiger | |
| 7,144,302 | B2 | 12/2006 | Bolz et al. | |
| 7,625,439 | B1 * | 12/2009 | Devine et al. | 106/14.42 |
| 2002/0088773 | A1 | 7/2002 | Holland et al. | |
| 2004/0097170 | A1 * | 5/2004 | Bolz | B24B 1/00 451/36 |
| 2005/0014597 | A1 * | 1/2005 | Michaud et al. | 475/344 |
| 2005/0164610 | A1 | 7/2005 | Michaud et al. | |

FOREIGN PATENT DOCUMENTS

| | | | |
|---|---|---|---|
| EP | 0845327 | A3 | 6/1998 |
| EP | 0922530 | A2 | 6/1999 |
| EP | 0922530 | A3 | 6/1999 |
| JP | 58-136255 | U | 9/1983 |
| JP | 09-085608 | A | 3/1997 |
| JP | 2006142475 | A | 8/2006 |
| JP | 2007516096 | A | 6/2007 |

OTHER PUBLICATIONS

Fischer, Juergen, et al. Basic Studies Concerning Accelerated Vibratory Surface Finishing (CAVSF), Tri-Service Corrosion Conference 2007, Engineered Surfaces Center, Grand Forks, ND, USA, pp. 1-23.

Winkelmann, L, et al. Superfinishing Motor Vehicle Ring and Pinion Gears, Technical Paper, American Gear Manufacturers Association, Alexandria, Virginia, Oct. 2004, 04FTM13.

Hashimoto, Munetoh et al. Studies on Improvement of Surface Durability of Case-Carburized Steel Gear—Effects of Surface Finish Processes upon Oil Film Formation, Technical Paper, American Gear Manufacturers Association, Alexandria, Virginia, 98FTM9, pp. 1-9.

Search Report in corresponding EP App. No. EP09166875.6, dated Oct. 27, 2009.

Search Report in corresponding International App. No. PCT/US2010/034309, dated Oct. 22, 2010.

Japanese Patent Application No. 2012-510913, non-certified English Translation of Office Action dated Apr. 1, 2014.

* cited by examiner

Before

| | | |
|---|---|---|
| Ra | 1.50 | µm |
| Rmax | 8.11 | µm |
| Rt | 8.12 | µm |
| Rz | 5.54 | µm |

After 10 mins:

| | | |
|---|---|---|
| Ra | 0.17 | µm |
| Rmax | 2.28 | µm |
| Rt | 2.38 | µm |
| Rz | 1.63 | µm |

| Ex. | Chemistry | Chemistry Amount | Turret Speed | Spindle Depth (mm) | Temp (C) | Process Time (min) | Gear: Starting Ra (um) | Final Ra (um) | Comments |
|---|---|---|---|---|---|---|---|---|---|
| | Baseline | | | | | | | | |
| 1 | FML 7800 - 35% | 76 L - Drained | 55% | 600 | 43 | 10 | Ring: 1.2-1.7 | 0.37-0.5 | Media was wet - very light coating on ring gear. Vessel was filled with 20 gallon, stirred and drained. |
| 2 | FML 7800 - 20% | 11 L /hour | 0% | - | 43 | 60 | Ring: 1.2-1.75 | 0.15-0.2 | Ring and pinion fixtured and floated in Sweeco 10 ft CAVF bowl |
| 3 | FML 7800 - 35% | 76 L | 55% | 600 | 43 | 10 | Ring: 1.2-1.7 | 0.12-0.2 | baseline |
| Effect of Flooding | | | | | | | | | |
| 4 | FML 7800 - 35% | 114 L | 55% | 600 | 43 | 10 | Ring: 1.2-1.7 | 0.05-0.1 | Very heavy coating. Planarized. Faster than 76 L. |
| 5 | FML 7800 - 35% | 76 L | 55% | 650 | 43 | 10 | Ring: 1.2-1.7 | 0.07-0.125 | 50 mm deeper than baseline |
| 12 | FML 7800 - 35% | 6.9 L/minute | 55% | 600 | 48 | 10 | Ring: 1.2-1.5 | 0.05-0.1 | Chemistry delivered onto parts in orbital path. No puddling at bottom of bowl |
| 13 | FML 7800 - 35% | 0.63 L/minute | 55% | 600 | 43 | 10 | Ring: 1.2-1.5 | 0.50-0.76 | Chemistry delivered onto parts in orbital path. No puddling at bottom of bowl |
| Effect of Temperature | | | | | | | | | |
| 6 | FML 7800 - 35% | 76 L | 55% | 600 | 24 | 10 | Ring: 1.2-1.7 | 0.75-0.87 | Very slow refinement |
| 7 | FML 7800 - 35% | 76 L | 55% | 600 | 49 | 10 | Ring: 1.2-1.7 | 0.12-0.2 | baseline |
| 8 | FML 7800 - 35% | 76 L | 55% | 600 | 57 | 10 | Ring: 1.2-1.7 | 0.02-0.07 | Mirror smooth surface |
| Effect of Turret speed | | | | | | | | | |
| 9 | FML 7800 - 35% | 76 L | 35% | 600 | 43 | 10 | Ring: 1.2-1.7 | 0.12-0.2 | Media is more fluid |
| 10 | FML 7800 - 35% | 76 L | 10% | 600 | 43 | 10 | Ring: 1.2-1.7 | 0.17-0.3 | No wake. 10% is minimum setting. |
| 11 | FML 7800 - 35% | 76 L | 0% | 600 | 43 | 10 | Ring: 1.1-1.4 | 1.0-1.1 | spindle only rotation at 40 rpm, 1cm below media surface |

Fig. 4

HIGH THROUGHPUT FINISHING OF METAL COMPONENTS

CROSS REFERENCE TO RELATED APPLICATIONS

This application claims the benefit of U.S. Provisional Patent Application Ser. No. 61/215,981, which was filed on May 12, 2009 and hereby is incorporated by reference in its entirety.

BACKGROUND OF THE INVENTION

1. Field of the Invention

The invention relates generally to finishing procedures for metal components and more particularly to an accelerated finishing procedure capable of producing an extremely smooth surface finish in a reduced time.

2. Description of the Related Art

Procedures for producing a smooth surface finish on a metallic component are generally well known. Such procedures include barrel tumbling, abrasive vibratory finishing, grinding, honing, abrasive machining and lapping. Examples of mechanical parts that may be finished using these procedures include splines, crankshafts, camshafts, bearings, gears, constant velocity (CV) joints, couplings, and journals. Various advantages may be achieved by such finishing including a reduction in wear, friction, noise, vibration, contact fatigue, bending fatigue and operating temperature in the mechanism to which they relate. Although not all of the mechanisms are understood by which this may be achieved, it is believed that the reduction of surface asperities and distressed metal can reduce friction and prevent scuffing, abrasive wear, adhesive wear, brinnelling, fretting and contact fatigue and/or bending fatigue at the relevant metal-to-metal contact or non-contact dynamically stressed surfaces. Alternatively, objects may be provided with a finish for aesthetic reasons or for corrosion resistance reasons. The actual effectiveness of the finish in achieving these effects appears to depend not only on the final smoothness but also on the manner in which it is achieved.

The type of finishing process is believed to play a role due to the microscopic relief that characterizes the manner in which the finish has been achieved. This can depend on the polishing mechanism, chemicals used, local temperature effects, isotropic or non-isotropic nature and many other factors.

Early vibratory finishing techniques used motor-driven vibratory bowls or tubs in which the component would be free floated and allowed to agitate in the presence of abrasive media. By free floated, it is meant the components are allowed to be carried around the vessel by the movement of the media mass. The degree and rate of finishing is primarily controlled by the coarseness, amount and or replenishment of the abrasive grit used in the media mass. Such processes are based on the mass finishing techniques used, for example, for polishing stainless steel tool handles in which ever finer polishing media is used to achieve the desired degree of finish. However, metal components such as gears or bearings found in the aerospace or automotive sectors are typically induction hardened, case carburized or through hardened to a hardness of 50 HRC or above. Conventional abrasive techniques may require unacceptably long processing times of 12 hours or more to achieve the desired smoothness. In other processes, appropriate chemicals have been introduced into the mass finishing container in order to enhance the finishing capability and action of the media. U.S. Pat. Nos. 3,516,203 and 3,566,552 are examples of such procedures. According to U.S. Pat. No. 6,261,154 to McEneny, the contents of which are incorporated herein by reference in their entirety, additional forces may be induced by rotating a workpiece around its axis in a fixed position against the flow of finishing media.

Further procedures have been developed in which increased levels of mechanical energy are imparted onto the component by moving the component through relatively stationary media. One such procedure is known as drag finishing and is described in e.g. U.S. Pat. No. 4,446,656 to Kobayashi, the contents of which are incorporated herein by reference in their entirety. According to such procedures, finishing is solely an abrasive process. The high levels of energy and the speed of abrasion can however be detrimental to the geometrical tolerance of metal components such as gears or bearings. This is particularly the case where the direction and location of media impingement on the component is not uniform over the treated surface. In an effort to improve uniformity, complex movement geometries are imparted onto the components involving rotation around multiple axes. One such drag finishing machine is described in U.S. Pat. No. 6,918,818 to Böhm, the contents of which are incorporated herein by reference in their entirety. In this device, individual components may be fixtured to a drive spindle for finishing. The total throughput of components is determined by the process time and the fixturing time for connecting and disconnecting components from the drag spindle.

One procedure that can achieve an ultra-smooth superfinished surface is chemically accelerated vibratory finishing (CAVF). A chemically accelerated vibratory finishing technique has been developed and described in numerous publications by REM Chemicals, Inc. This technique may be used to refine metal parts to a smooth and shiny surface and has been used commercially for many years. U.S. Pat. No. 4,818,333 to Michaud and U.S. Pat. No. 7,005,080 to Holland, the contents of which are incorporated herein by reference in their entirety, disclose this improved finishing technique. A significant difference between this technique and abrasive media based processes is that in a chemically accelerated finishing process, the media does not significantly abrade the metal surface. The combination of the media plus the mechanical energy imparted by the mass finishing equipment in question is not capable of effectively removing material from the surface of the component without accelerated chemistry. Mixed processes have also been suggested.

Another important characteristic of surfaces produced by CAVF is that they are planarized. This means that the uneven surface prior to finishing is made smoother by removal of the upwardly protruding asperities with little change to the form of any depressions or valleys. While not wishing to be bound by theory, the resulting surface is characterized by flat plateaus, understood to have good load bearing characteristics separated by crevices facilitating oil retention. These planarized surfaces are also believed to have the advantage of substantially no peaks that would otherwise penetrate through a lubricant film and cause damage with a mating surface. A chemically accelerated vibratory finish of below 0.5 microns Ra tends to exhibit some or all of the performance benefits discussed above.

A significant factor in the use of CAVF is the amount and concentration of chemistry used. The chemicals are acidic and excess chemistry and or concentration or elevated temperatures can cause etching of the surface of the component being finished and/or can cause other metallurgical deterioration of the metal. Components of high hardness are also often more susceptible to chemical attack such as etching from chemicals typically used in CAVF. In general, if etching occurs, components such as gears or bearings will likely be scrapped. In order to avoid such damage, the amount and type of chemistry and temperature of the process is carefully matched to the amount of media and the surface area of the components to be finished. Typically, flow-through processing is utilized. In flow-through processing, the vibratory vessel operates in an open air environment at room temperature, and is provided with a chemistry delivery system in which the accelerating liquid chemistry, at ambient room temperature, is metered continuously into the vessel during the surface refining process. Simultaneously, an open drain in a low point in the vessel continuously drains away excess liquid such that puddling does not occur during operation. To avoid etching and to operate efficiently, the amount of flow-through chemistry should be just sufficient to wet all of the media and components, and should be at a concentration just sufficient to react with the amount of surface area of the metal components being finished. Thus, excessive inflow of liquid is avoided to prevent a build up of liquid volume within the vessel to avoid etching. Similarly a blockage of the drain causing an accumulation of chemistry in the vibratory vessel can lead to etching and subsequent scrapping of all the components. Temperatures above ambient room temperature within the vibratory vessel, irrespective of the amount of liquid within the vessel, can also increase the potential of etching and scrapping of such components.

Tests have been performed in order to determine optimum conditions for CAVF. In a paper at the Tri-Services Corrosion Conference 2007 by Juergen Fischer entitled "Basic Studies Concerning Chemically Accelerated Vibratory Surface Finishing" it is concluded that greater finishing speed may be achieved using reduced chemical hold up, and that the process showed no visible temperature dependency in the range studied.

An advantage of vibratory finishing in a bowl or tub is that many individual components may be finished in a single batch. Such batch finishing may not, however, be convenient in an item-by-item (just in time) production line environment or where components must be individually identified or matched. In particular in relation to gear assemblies, it is often the case that two or more components are matched, for example, by a lapping process. Thereafter, it is desirable that the matched parts are kept together during subsequent operations. For such components, batch (mass) finishing is generally not suitable. Mass finishing may also be unsuitable in cases where delicate components may not knock against one another in the vibratory process. Many other finishing processes have been suggested and developed, but none has proven suitable for high-throughput, in-line, mass-finishing (such as a vibratory bowl, tub or tumbling barrel) of large numbers of components requiring special handling.

Thus, there is a particular need for a device and procedure that allows at least some of these problems to be overcome.

BRIEF SUMMARY OF THE INVENTION

The present invention addresses these problems by providing a method for finishing a surface of a metal component, comprising: providing a receptacle containing a quantity of non-abrasive media sufficient to substantially immerse a part of the component on which the surface is located; providing a quantity of finishing chemistry capable of forming a relatively soft conversion coating on the surface; immersing the component at least partially into the media; flooding the receptacle with an excess of the chemistry such that the surface is essentially immersed in the chemistry; and inducing high energy relative movement between the surface and the media in order to continuously remove the conversion coating. By flooding the receptacle with excess chemistry in combination with high energy relative movement, an acceptable level of finish may be achieved in a significantly reduced time. Time reductions from 60 minutes or more for a standard CAVF process to two minutes for a flooded high energy process have been achieved. In the following, mention of "the surface" will be understood to refer to the surface which is to be specifically finished. It will be understood that other parts of the component may be masked to avoid treatment, held above the chemistry level or partially treated (i.e. whereby the degree of finish may be unimportant).

In the context of the invention, the term "flooded" is intended to refer to the presence of a quantity of chemistry sufficient to continuously form the conversion coating at a rate equivalent to full immersion in the chemistry. Various alternatives may be available to maintain such excess chemistry. It may be achieved by maintaining, for example, a defined level of chemistry in the receptacle and literally immersing the component in the chemistry or by continuously supplying the chemistry at a high rate, sufficient to "effectively" immerse the component.

In the case that the component is literally immersed, preferably, at least half of the surface to be finished is immersed into the finishing chemistry. Depending upon the shape and movement of the component, partial immersion may be sufficient to agitate the media and chemistry to achieve adequate flushing of the whole surface by the chemistry. More preferably however, the complete surface is immersed below the level of the chemistry throughout the complete cycle. It will be understood that once the component begins to agitate the media and chemistry, the exact level of the chemistry may be difficult to define. For this reason, reference to immersion is intended to refer to the position relative to the quiescent level of chemistry in the receptacle.

Alternatively, effective immersion may be achieved by supplying finishing chemistry to the receptacle at a rate of at least 0.1 liters per hour per liter of media and most preferably at significantly higher rates e.g. more than 0.5 liters per hour per liter. This may be achieved without significant hold-up within the receptacle by ensuring adequate drainage. Conventional CAVF processes working in flow-through conditions have operated in the past with a constant supply of chemistry. This supply was generally limited to a relatively low value in order to prevent undesirable etching of the components. The exact amount of flow would be calculated to keep the media in a 'just wetted' condition and would thus depend upon the quantity of media being used. This amount would generally be no more than 0.04 liters per hour per liter of media.

In both cases, the method may comprise continuously supplying fresh finishing chemistry to the receptacle. The chemistry may be supplied to the receptacle in a through-flow process and can be used to assist in maintaining a chosen temperature within the receptacle. The chemistry may circulate and be reused and/or replenished. The circulating flow may include filters, heat exchangers and the like. In the literally immersed embodiment, the defined level of the finishing chemistry may be determined by overflow outlets from the receptacle. Chemistry in excess of this level automatically overflows and may be recirculated.

The process is continued until a surface roughness Ra of the surface is less than 0.5 microns, preferably less than 0.35 microns and even as low as 0.1 micron. The precise degree of finish is dependent upon the intended use. The finish is also planarized and preferably isotropic i.e. there is no directional pattern of lines. This is however at least partially dependent upon the manner in which the high energy is imparted between the surface and the media. It should be noted however that the surface will often be left with a conversion coating covering and thus it will not necessarily appear mirror-like.

According to one important aspect of the invention, the process may be carried out at a temperature greater that 40° C. (104° F.), preferably greater than 50° C. (122° F.) and even greater than 70° C. (158° F.). Prior art CAVF processes have been carried out at ambient temperature, in particular temperatures between 18° C. and 35° C. (65-95° F.) have been recommended. It was previously understood that elevated temperatures around 40° C. (104° F.) were detrimental to the procedure and could cause etching of the component. According to the present high energy procedure, elevated temperatures have been found desirable in further reducing the time to completion—without the negative effects of etching. The elevated temperature may be achieved by heating coils or elements, heated chemistry and the like. Since the high energy process itself generates considerable energy, insulation of the receptacle alone can be sufficient to produce elevated temperatures, and under certain circumstances provision should be made to prevent it from rising excessively. The temperature may also be adjustable in order to regulate the finishing speed or adapt to other process parameters.

According to a further embodiment of the invention, the defined level of the finishing chemistry is adjustable. This may be convenient for adjusting the process parameters to finish a component more or less quickly or to accommodate different sizes of component According to one preferred embodiment, the receptacle is a drag finishing bowl and the relative movement takes place by forcing the component through the media. In this context drag finishing is understood to mean a system where a component is forced through a quantity of relatively stationary media. No particularly direction of movement is required and the term is not intended to be limited to pulling motions alone. Such a system has the advantage that relatively large forces may be applied to the component thereby inducing the required high-energy relative movement between the surface and the media. The skilled person will understand that the effectiveness of removal of the conversion coating will depend at least partially on the relative speed of movement of the surface and media and the pressure exerted by the media upon the surface. The precise dynamics are complex and will be governed by flow mechanics for particulate material. Nevertheless, drag finishing systems have been shown to be very effective in maximizing energy transfer at the treated surface. Comparative testing has been performed using abrasive media in drag finishing, centrifugal disk finishing and vibratory finishing machines. Using abrasive media only, the material removal is closely linked to the energy transmitted to the surface. According to such tests it has been shown that a correctly set up drag finishing arrangement may impart 100× more energy to the surface than a vibratory process. A centrifugal disk machine imparts around 30× more energy than a vibratory machine, but still 3× less than a drag finishing machine.

It may also be noted that in conventional drag finishing the component moves while the media is relatively stationary. For this reason, energy wastage and attrition of the media due to internal forces acting within the media is reduced. In general, drag finishing without vibratory agitation of the media is therefore preferred. Such vibration can also reduce the media pressure on the surface by "fluidizing" the media. Under certain circumstances however vibration may be used e.g. where such a reduced pressure is desirable. Alternative devices for causing high-energy relative movement may also be used, including systems where the media moves relative to a stationary component such as a rotating bowl or the device disclosed in U.S. Pat. No. 6,261,154 above.

Preferably, the high energy relative movement takes place at a relative velocity of at least 0.5 m/s, more preferably, at least 1.0 m/s. It will be understood, that precise velocity measurements may be difficult to determine and that the above values represent average rates of media flow across the surface.

In a most preferred form of finishing system, the component is carried by a fixture and the fixture is driven to rotate the component about at least one axis of rotation. A device that has proven effective in achieving the desired motion is the drag finisher as described in U.S. Pat. No. 6,918,818. Such a device comprises a number of spindles on a central turret. The spindles rotate around the turret and also around their own axes, in the manner of a bread or cake mixer. Each spindle carries a fixture for holding a component. The turret may be rotated at speeds of from about 6 to 60 rpm, which for motion along a circle of diameter 1.0 m, leads to linear speeds of the component through the media of from around 0.25 to 2.5 m/s.

The process of the invention is particularly suited to the surface treatment of automobile or truck components, most preferably ring or pinion gears, for example, for a rear axle or transaxle of a car or truck. Such automotive components are mass produced and widely used. The use of an efficient and cost-effective finishing procedure can therefore be extremely beneficial in increasing market acceptance, leading to increased energy efficiency and other advantages in the resulting vehicles.

In a particularly advantageous embodiment of the invention, the component comprises at least two matched parts and the matched parts are finished together. The matched parts may comprise a hypoid ring and pinion gear for a rear axle or transaxle that have been lapped together. By fixturing both components within the receptacle, both components may be subjected to the same finishing procedure and for the same time.

According to the method of the invention, the chemistry should be capable of effectively forming and re-forming a relatively soft conversion coating on the surface of the component. In this context, relatively soft is understood to mean that it is softer than the material of the component itself. The chemistry should also preferably be self-passivating, in that once the conversion coating is formed, it protects the underlying metal from further chemical attack. It is hereby understood, that such self-passivating effect is dependent upon the particular reaction conditions. The chemistry should also be suitable for use in the high energy processing environment and operating conditions of the current invention such that surface refinement occurs without detrimental side effects. This gives a wider degree of freedom in chemical choice than was previously available. The skilled person in the field of CAVF will be well aware of such chemistries which may include, but are not limited to, phosphate or oxalate based mixtures. Preferably, the chemistry is acid based, having a pH of less than 7.0, preferably less than 6.0. In particular, the chemistry may comprise phosphoric acid or phosphates, sulfamic acid, oxalic acid or oxalates, sulfuric acid or sulfates, chromic acid or chromates, bicarbonate, fatty acids or fatty acid salts, or mixtures of these materials. The solution may also contain an activator or accelerator, such as zinc, selenium, copper, magnesium, iron phosphates and the like, as well as inorganic or organic oxidizers, such as peroxides, meta-nitrobenzene, chlorate, chlorite, persulfates, perborates, nitrate, and nitrite compounds. Most preferable are phosphoric acid, oxalic acid and their salts. These chemicals have been proven in conventional CAVF techniques and have been found to also operate effectively under high energy conditions. The preferred concentrations of such chemistry may be higher than the concentrations used in conventional flow through CAVF techniques. Preferred concentration values of active ingredient for the oxalate radical are from about 0.125 to 0.65 gram mole per liter. The chemistry may also or alternatively include about 0.05 to 0.15 gram mole per liter of the phosphate radical, at least about 0.004 gram mole per liter of the nitrate radical, and about 0.001 to 0.05 gram mole per liter of the peroxy group. The oxalate radical, nitrate radical and peroxy group may be provided, respectively, by oxalic acid, sodium nitrate and either hydrogen peroxide or sodium persulfate. As a further useful consequence of the high energy environment, chemistries may be used which form a harder conversion coating than those conventionally used in CAVF.

The invention is believed to be applicable to components made from many different metals and alloys but is particularly suitable for finishing surfaces of alloy steel, carbon steel, tool steel, stainless steel, titanium, cobalt-chrome, tungsten carbide, aluminum, brass, zinc and superalloys, preferably having large amounts of nickel, cobalt or nickel-iron. Most preferably, the invention is applicable to mass-produced steel components where the finish must be produced efficiently at minimum cost. Such components may be hardened e.g. induction hardened, case hardened or through hardened and may have hardness values of greater than 38 HRC and even greater than 54 HRC. The skilled person will understand that the material will be selected according to the nature of the component and also that the above choice of chemistry will also depend upon the material of the surface to be finished.

The method of the invention may further comprise removing the component from the receptacle containing the conversion coating chemistry and immersing it in a further receptacle comprising a burnishing or coating solution or otherwise performing a coating process. Such additional processes may be performed in the same receptacle but in the interests of procedural efficiency it is generally preferred to remove the component (or components) from the first receptacle such that processing of further components may commence. Further processing of the unfixtured components may then take place off-line if so required. For a turret based drag finishing arrangement, it is advantageous for the turret with fixtured components to raise whereby a further vessel may be moved into position beneath the turret for the further processing step without the need to unfixture the components between steps. Alternatively, the turret may move from one receptacle to another.

According to an important aspect of the invention for certain chemistries, at the end of the finishing cycle, the process may further comprise leaving the component in the conversion coating chemistry for a dwell time, with substantially no relative movement in order to develop a substantial conversion coating on the surface. Such conversion coatings may be highly beneficial for various purposes in relation to the final or intermediate product. Such advantages may include rust prevention, retaining of a rust preventative, acting as a pre-paint layer, or aiding in breaking-in the part once put into service. The skilled person will be well aware of the effects and advantages that may be achieved by providing conversion coatings of this nature and will be able to choose appropriate chemistries accordingly. By performing such a coating process in a single step with the finishing process, an additional coating process is not required, leading to further efficiencies. By adjusting dwell time, temperature and other parameters, the thickness and nature of the coating may be adjusted.

The media may comprise commercially available ceramics, metals or plastic media found in conventional mass finishing applications. Key features of the media are that it should be essentially non-abrasive i.e. the media does not have discrete abrasive particles and it is not capable of effectively abrading material off the surface of the part to be finished when operated in the high energy processing environment of the present invention. It should also be manufactured in suitable shape and size for the part to be finished. In one preferred embodiment the media is non-abrasive ceramic media having a density of at least about 2.75 grams per cubic centimeter (g/cc), a bulk density of at least about 1.70 grams per cubic centimeter (g/cc) and preferably an average diamond pyramid hardness (DPH) value of at least about 845. One preferred shape for the media is a triangular prism of suitable size to contact all parts of the surface to be finished.

The invention also relates to a drag finishing machine for accelerated finishing of a surface of a metal component, comprising: a receptacle containing a quantity of non-abrasive media sufficient to substantially immerse a part of the component on which the surface is located; a chemistry supply arrangement for supplying and maintaining a defined level of finishing chemistry within the receptacle; a heating arrangement for maintaining the interior of the receptacle at an above ambient temperature; and a drive comprising an attachment arrangement for the component, for inducing high energy relative movement between the component and the media in the receptacle. The drag finishing machine is provided with a control arrangement adapted to control the machine to perform the method as described above, whereby reduced processing times may be achieved for individually fixtured components. In particular, the control arrangement is adapted to operate the machine for a cycle time of less than 15 minutes, preferably less than 10 minutes and most preferably less than 5 minutes.

Preferably, the chemistry supply arrangement further comprises one or more overflow outlets arranged at the defined level. Chemistry delivered to the receptacle can fill it up to the defined level while surplus exits via the overflow outlets. The chemistry may be circulated continuously and delivered back to the receptacle. The outlets may be provided with appropriate filters to prevent exit of media and trap particulate material.

In a preferred embodiment of the machine, the heating arrangement comprises heating elements within or around the receptacle in order to keep the contents at the desired process temperature. As described above, various methods of heating may be envisaged and the heating elements may be electrical or fluid based heating elements e.g. within the walls of the receptacle or around its outer circumference. Insulation may also be provided.

Alternatively temperature control can be achieved via heating/cooling of the recirculated chemistry in an exterior solution reservoir arrangement where chemical additions and or filtration can also be carried out.

A preferred form of machine is of the type wherein the drive comprises a turret arranged to rotate the component about a plurality of axes. The turret may rotate about a first axis and carry spindles that also rotate about their own axes. The component itself may also be mounted to rotate about its own axis and may be driven or free-turning. The axes may be parallel or tilted. The turret may also reciprocate into and out of the media during operation. The skilled person will understand that any other form of one-, two- or three-dimensional movement that induces sufficient energy between the media and the surface may also be suitable.

The machine preferably comprises a quick-release fixture for releasably attaching the component. In this context, quick-release is understood to mean a fixture that can be attached and released without an incremental tightening action such as a screw-thread. Quick release mechanisms may include, but are not limited to: magnets, electro-magnets, bayonet fittings, cams and the like.

In a particular embodiment of the invention, the receptacle has a stainless steel inner surface or other suitable chemically resistant metal (e.g., cobalt-chromium). Conventional bowls for drag finishing are often rubber or plastic lined, in particular with urethane. Such linings serve to reduce abrasion of the receptacle, but do not readily enable heating and are in some cases not suitable for high temperature operation. A stainless steel or other suitable metal liner has been found more adequate for operation at elevated temperatures.

BRIEF DESCRIPTION OF THE DRAWINGS

The features and advantages of the invention will be appreciated upon reference to the following drawings, in which:

FIG. 4 is a table showing the results of Examples 1 to 13 (operation of the machine 10).

DESCRIPTION OF ILLUSTRATIVE EMBODIMENTS

The following is a description of certain embodiments of the invention as used in the finishing of ring and pinion gears, given by way of example only and with reference to the drawings.

Figure 1:
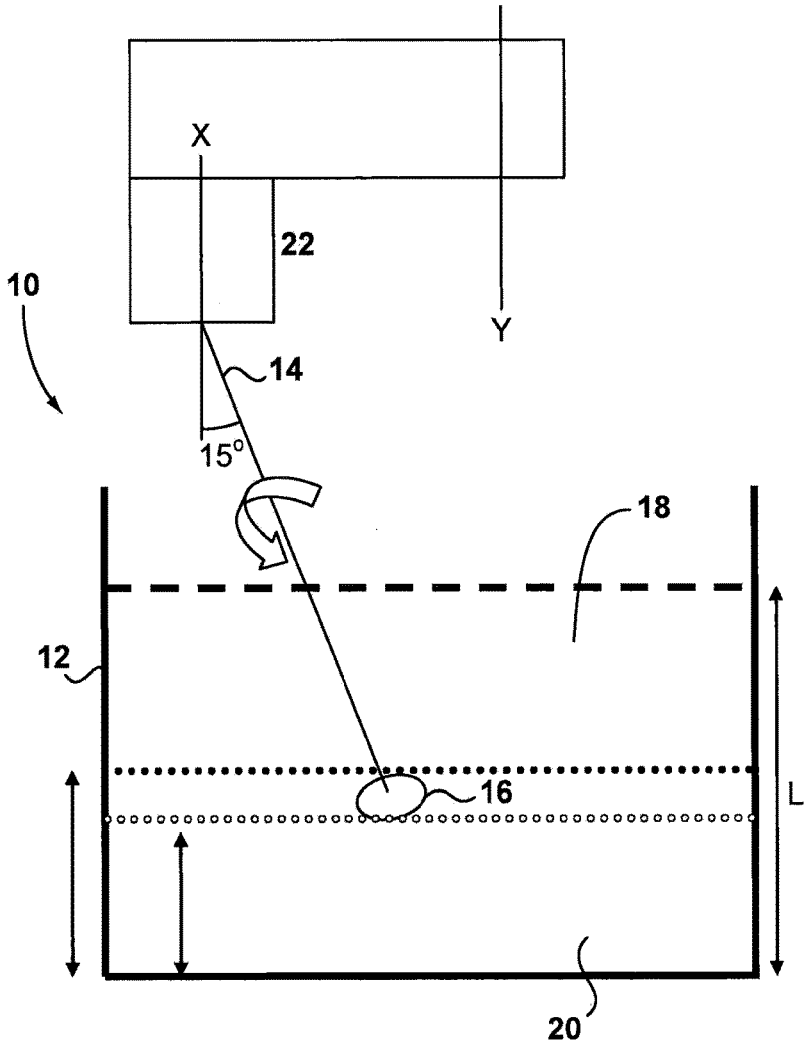
FIG. 1 is a schematic view of a drag finishing machine according to the invention.
Figure 2:
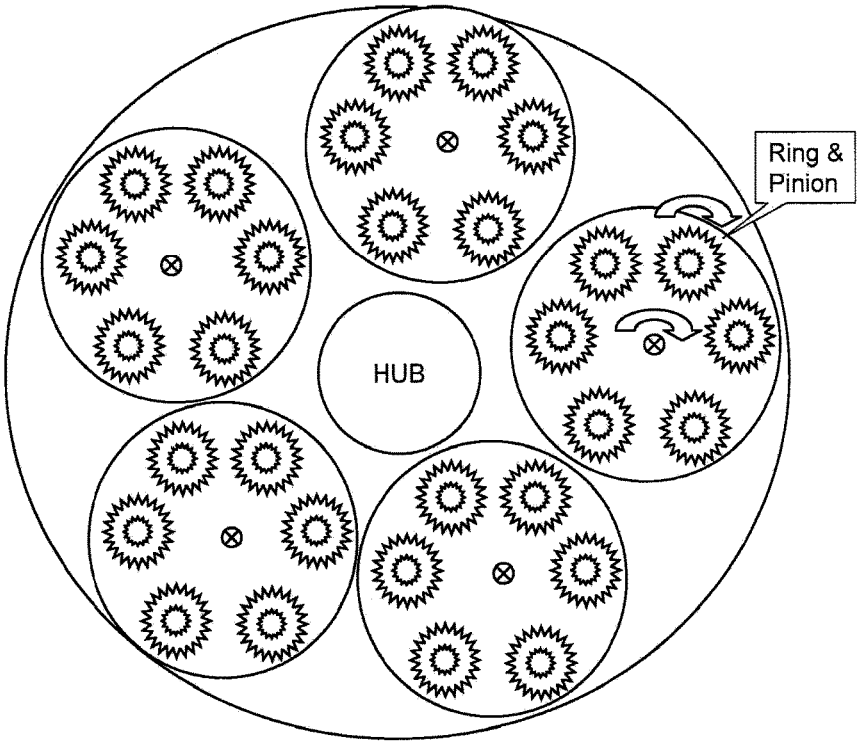
FIG. 2 is a plan view of a drag finishing machine according to a further aspect of the invention.

Referring to FIG. 1, a drag finishing machine 10 is schematically shown. The machine 10 is a Mini Drag Finisher available from Rösler Metal Finishing, USA LLC. Nevertheless, the skilled person will understand that many other machines having similar capabilities could be adapted for operation according to the invention.

The machine 10 comprises a receptacle in the form of an annular bowl 12. A spindle 14 carries a component 16 to be treated. The spindle 14 is driven to rotate around an axis X. In this example, the axis X is angled with respect to the vertical at around 15°. The spindle 14 is mounted on a turret 22 which rotates around an axis Y. Axes X and Y are offset from one another by a distance of about 50 cm whereby the spindle 14 traces a circle of around 1.0 m diameter.

The bowl 12 is filled with non-abrasive media 18 up to a defined level L. The media used during testing was a non-abrasive ceramic media having a density of about 2.75 grams per cubic centimeter (g/cc) and an average diamond pyramid hardness (DPH) value of about 845. The media had an overall bulk density of about 1.70 grams per cubic centimeter. The media shape was chosen to be a triangular prism of size 3 mm along the edge of the triangles, and 5 mm along the other sides of the rectangular faces. The size and shape of the media was chosen such that it would sufficiently fit all the way into the root of the ring and pinion gear teeth without lodging.

A quantity of chemistry 20 was supplied to the bowl as specified further in the examples below. The chemistry used was FERROMIL® FML 7800 available from REM Chemicals Inc of Brenham, Tex., which is a phosphate-based chemically accelerated chemistry that produces a suitable conversion coating when used in a drag finishing environment on steel components. Similar chemistries that may also be used include Microsurface 5132™, available from Houghton International, Valley Forge, Pa., Aquamil® OXP available from Hubbard-Hall of Waterbury, Conn., the Quick Cut II® CSA 550 (CF), available from Hammond Roto-finish of Kalamazoo, Mich. and Chemtrol®, available from Precision Finishing Inc of Sellersville, Pa.

The ring and pinion gear sets on which testing was carried out were for light axle ring and pinions for automotive vehicles. The sizes of the gears were approximately 18 cm and 23 cm ring gears and their mating pinion. The gears were manufactured according to standard automotive manufacturing processes.

Operation of the machine 10 was carried out according to the following examples.

EXAMPLE 1

In a first example, the bowl 12 was filled with media 18 to a level of approximately 406 mm depth. The media comprised non-abrasive 3×5 SCT (straight cut triangles). A quantity of 76 litres of chemistry of type FERROMIL® FML-7800 diluted at 35 vol % and pre-heated, was added to the bowl. The media was stirred and then the chemistry was drained, leaving the media wet and at a temperature of around 43° C. (all temperature was measured using an infra-red heat sensor gun reading off the top of the media). A rear axle hypoid ring gear of 23 cm diameter was attached to the spindle 14 and lowered into the bowl to a depth at which the bottom of the ring gear was around 160 mm from the bottom of the bowl. The gear had an initial surface finish of 1.2-1.7 microns. The turret 22 was driven for 10 minutes at about 31 rpm and the spindle rotated at about 40 rpm. After 10 minutes the ring gear was removed and inspected. The surface roughness after processing for 10 minutes was determined to be 0.37-0.5 microns. All surface roughness measurements are given as average Ra based on measurements of the contact area of the teeth at five or six locations on both concave and convex sides. The upper and lower values were taken to determine the Ra range. Measurements were performed using a T1000 Hommel gauge with stylus tip radius of 2 micron.

EXAMPLE 2

As a control, a ring gear of similar type to Example 1 was finished using conventional vibratory finishing in a Sweco approximate 300-liter bowl. The bowl was operated at an amplitude of 4.5 mm and a lead angle of 65°. The media comprised 3×5 SCT as in Example 1. The chemistry used was FERROMIL® FML-7800 at a 20 volume % concentration (the chemistry of Example 1 would have been unusable in this example as it would have caused etching), delivered on a flow through based at a rate of 11 litres per hour at ambient temperature. The ring gear had an initial surface roughness of 1.25-1.75 microns. It required 60 minutes of processing time to achieve a surface roughness of 0.15-0.2 microns.

EXAMPLE 3

The procedure of Example 1 was repeated except that instead of draining the bowl it was instead filled with 76 litres of chemistry to a level of around 200 mm. On lowering the ring gear into the bowl, the ring gear was substantially immersed in the chemistry. After 10 minutes of processing, the part has a surface roughness of 0.12-0.2 microns. An example trace taken before and after processing is shown as FIG. 3.

EXAMPLE 4

The procedure of Example 3 was repeated with 114 litres of chemistry, reaching a level of approximately 300 mm within the bowl. In this case, the ring gear was deeply immersed in the chemistry during processing. After 10 minutes, the ring gear was measured and found to have a surface roughness of 0.05-0.1 microns.

EXAMPLE 5

The procedure of Example 3 was repeated with the spindle and ring gear being immersed deeper into the bowl to a distance of approximately 110 mm from the bottom of the bowl. After 10 minutes the ring gear was measured and found to have a surface roughness of 0.07-0.125 microns.

EXAMPLE 6

The procedure of Example 3 was repeated at a temperature of 24° C. After 10 minutes, the ring gear was measured and found to have a surface roughness of 0.75-0.87 micron.

EXAMPLE 7

The procedure of Example 3 was repeated with the temperature within the media held at 49° C. After 10 minutes, the ring gear was measured and found to have a surface roughness of 0.12-0.2 microns.

EXAMPLE 8

The procedure of Example 3 was repeated at a temperature of 57° C. After 10 minutes, the ring gear was measured and found to have a surface roughness of 0.02-0.07 microns.

EXAMPLE 9

The procedure of Example 3 was repeated with a reduced turret speed of about 20 rpm. After 10 minutes, the ring gear was measured and found to have a surface roughness of 0.12-0.2 microns. It was concluded that operation at this speed was sufficient to impart the required energy for fast finishing.

EXAMPLE 10

The procedure of Example 3 was repeated with a reduced turret speed at about 6 rpm. After 10 minutes, the ring gear was measured and found to have a surface roughness of 0.17-0.3 micron. Even at relatively low speeds, the driving of the ring gear through the media caused sufficient action to adequately finish the workpiece in a short time.

EXAMPLE 11

The procedure of Example 3 was repeated without turret rotation. Spindle rotation was maintained at about 40 rpm. After 10 minutes, the ring gear was measured and found to have a surface roughness of 1.0-1.1 microns. Despite the relatively high speed of rotation, the spindle-only action was ineffective in imparting energy to the surface to remove the conversion coating. While not wishing to be bound by theory, it is believed that the relatively stable rotation of the ring gear causes it to effectively "plane" over the media without significant impacts of the media particles on the gear surfaces.

EXAMPLE 12

The procedure of Example 3 was repeated without literal immersion of the component in the chemistry. Instead, chemistry was supplied at a rate of 6.9 liters per minute onto the spindle path and the drains from the bowl were opened to ensure no excess chemistry was retained. After 10 minutes, the ring gear was measured and found to have a surface roughness of 0.05-0.1 microns. This shows that excess chemistry that essentially immerses the component was as effective as Example 3.

EXAMPLE13

The procedure of Example 11 was repeated at a rate of 0.63 liters per minute onto the spindle path. After 10 minutes, the ring gear was measured and found to have a surface roughness of 0.50-0.76 microns. This delivery rate was more than double that conventionally used in CAVF processes but shows a significant drop off in finishing speed.

Figure 3:
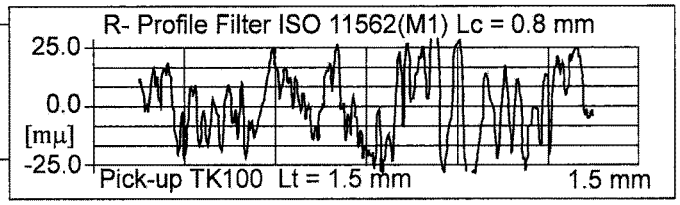
FIG. 3 is a surface roughness trace of the ring gear of Example 3.
Figure 3:
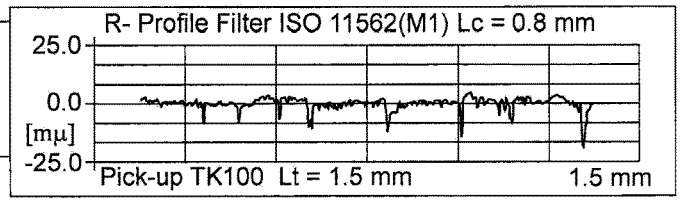

The results of Examples 1 to 13 are depicted in FIG. 4. A surface roughness trace of the ring gear of Example 3 is shown in FIG. 3. It can be seen that the combined effects of elevated temperature, high energy relative movement and excess chemistry lead to a suitably planarized and finished surface in an amount of time that was significantly less than that of the conventional CAVF process of Example 2.

Thus, the invention has been described by reference to certain embodiments discussed above. It will be recognized that these embodiments are susceptible to various modifications and alternative forms well known to those of skill in the art. In particular, the skilled person will understand that the above examples may equally apply similarly to splines, crankshafts, camshafts, bearings, gears, couplings, journals, and medical implants.

Further modifications in addition to those described above may be made to the structures and techniques described herein without departing from the spirit and scope of the invention. Accordingly, although specific embodiments have been described, these are examples only and are not limiting upon the scope of the invention.

What is claimed is:

1. A method for finishing a surface of a steel component, comprising:

providing a receptacle containing a quantity of non-abrasive media;

immersing the surface of the component into the media;

flooding the receptacle with a quantity of finishing chemistry capable of forming a soft conversion coating on the surface, to a defined level in the receptacle, such that the surface is immersed in the chemistry;

forcing the component through the media at a relative movement between the component and the media greater than0.3 m/s using a fixture connected to the component, thereby continuously removing the conversion coating; and continuing to force the component through the media to achieve a surface roughness Ra of the surface of less than 0.5 micron in less than 10 minutes;

wherein the method is carried out at a temperature greater than 40° C.

2. The method of claim 1, wherein at least half of the surface is immersed into the finishing chemistry.

3. The method of claim 1, wherein the method is carried out at a temperature greater than 50° C.

4. The method of claim 1, wherein the defined level of the finishing chemistry is determined by overflow outlets from the receptacle.

5. The method of claim 1, wherein the defined level of the finishing chemistry is adjustable.

6. The method of claim 1, wherein the component is a ring or pinion gear for a rear axle or transaxle of a car or truck.

7. The method of claim 1, wherein the component comprises at least two matched parts and the matched parts are finished together.

8. The method of claim 1, wherein the chemistry is acid based.

9. The method of claim 1, further comprising removing the component from the receptacle and immersing it in a further receptacle comprising a burnishing or coating solution.

10. The method of claim 1, wherein the method is carried out at a temperature greater than 70° C.

11. The method of claim 1, wherein the method is continued until a surface roughness Ra of the surface is less than 0.35 micron.

12. The method of claim 1, further comprising continuously supplying finishing chemistry to the receptacle at a rate of at least 0.5 liters per hour per liter of media.

13. The method of claim 1, wherein the relative movement between the component and the media is at least 0.8 m/s.

14. The method of claim 1, wherein the relative movement between the component and the media is at least 1.5 m/s.

15. The method of claim 1, wherein the method is continued until a surface roughness Ra of the surface is less than 0.20 micron.

16. The method of claim 1, wherein the method achieves a surface roughness Ra of the surface of less than 0.35 micron in less than 10 minutes.

17. The method of claim 1, wherein the method achieves a surface roughness Ra of the surface of less than 0.20 micron in less than 10 minutes.

18. A method for finishing a surface of a steel component, comprising:

providing a receptacle containing a quantity of non-abrasive media;

immersing the surface of the component into the media;

continuously supplying a quantity of finishing chemistry to the receptacle to a defined level in the receptacle;

forcing the component through the media at a relative movement between the component and the media greater than 0.3 m/s using a fixture connected to the component, thereby continuously removing the conversion coating; and continuing to force the component through the media for less than 10 minutes to achieve a surface roughness Ra of the surface of less than 0.5 micron;

wherein the method is carried out at a temperature greater than 40° C.

19. The method of claim 17, wherein the relative movement between the component and the media is greater than 0.8 m/s.

20. The method of claim 17, wherein the relative movement between the component and the media is greater than 1.5 m/s.

21. The method of claim 17, wherein the finishing chemistry is supplied to the receptacle at a rate of at least 0.5 liters per hour per liter of media.

22. A method for finishing a surface of a steel component, comprising:

providing a receptacle containing a quantity of non-abrasive media;

immersing the surface of the component into the media;

flooding the receptacle with an excess of finishing chemistry capable of forming a soft conversion coating on the surface such that the surface is immersed in the chemistry;

forcing the component through the media at a relative movement between the component and the media greater than 0.3 m/s using a fixture connected to the component, thereby continuously removing the conversion coating; and continuing to force the component through the media to achieve a surface roughness Ra of the surface of less than 0.5 micron in less than 10 minutes while maintaining dimensional tolerance of the component;

wherein the method is carried out at a temperature greater than 40° C.

* * * * *